US011618065B2

(12) United States Patent
Sato et al.

(10) Patent No.: US 11,618,065 B2
(45) Date of Patent: Apr. 4, 2023

(54) ROLL FORMING MACHINE

(71) Applicant: NAKATA MANUFACTURING CO., LTD., Osaka (JP)

(72) Inventors: Takeyuki Sato, Osaka (JP); Tomoyasu Nakano, Osaka (JP); Feizhou Wang, Osaka (JP)

(73) Assignee: NAKATA MANUFACTURING CO., LTD., Osaka (JP)

( * ) Notice: Subject to any disclaimer, the term of this patent is extended or adjusted under 35 U.S.C. 154(b) by 0 days.

(21) Appl. No.: 16/765,851

(22) PCT Filed: Nov. 21, 2018

(86) PCT No.: PCT/JP2018/042936
§ 371 (c)(1),
(2) Date: May 20, 2020

(87) PCT Pub. No.: WO2019/103023
PCT Pub. Date: May 31, 2019

(65) Prior Publication Data

US 2020/0360975 A1 Nov. 19, 2020

(30) Foreign Application Priority Data

Nov. 22, 2017 (JP) ..... JP2017-224299

(51) Int. Cl.
*B21B 31/02* (2006.01)
*B21B 31/20* (2006.01)
(Continued)

(52) U.S. Cl.
CPC ..... *B21B 31/02* (2013.01); *B21B 31/20* (2013.01); *B21D 5/12* (2013.01); *B21B 31/08* (2013.01); *B21C 37/08* (2013.01)

(58) Field of Classification Search
CPC ..... B21B 31/08; B21B 31/10; B21B 31/22; B21B 31/32; B21B 31/02; B21B 31/20; B21C 37/08; B21D 5/12
(Continued)

(56) References Cited

U.S. PATENT DOCUMENTS 3,221,530 A * 12/1965 Swallow ..... B21B 31/103 72/239
3,342,054 A * 9/1967 Bond ..... B21B 31/06 72/234
5,685,188 A 11/1997 Rehag et al.

FOREIGN PATENT DOCUMENTS

DE 3515786 A1 * 11/1986
EP 2 883 628 A1 6/2015
(Continued)

OTHER PUBLICATIONS

International Search Report issued in PCT/JP2018/042936; dated Dec. 18, 2018.

*Primary Examiner* — Shelley M Self
*Assistant Examiner* — P Derek Pressley
(74) *Attorney, Agent, or Firm* — Studebaker & Brackett PC

(57) ABSTRACT

Changing of a horizontal roll in a horizontal roll stand involving readjustment of an amount of pressing is to be done readily and promptly. In order to achieve this, a horizontal roll stand 10 with a pair of built-in upper and lower horizontal rolls 11 is configured to retreat toward one side across a forming line. A fixed stand 40 stands upright on a counter-retreating side of the forming line. An overhang part 42 of the fixed stand 40 jutting out over the forming line is provided with a pressure device 43 that applies a pressing force to the horizontal rolls 11. The horizontal roll stand 10 includes a horizontal roll housing 12 with an opened top, receives the pressing force from the pressure device 43 via
(Continued)

the opened top, and retreats to the outside of the forming line while the pressure device 43 is left on the forming line. The overhang part 42 of the fixed stand 40 is engaged with the horizontal roll housing 12 of the horizontal roll stand 10 to support the horizontal roll housing 12 in the forming line.

7 Claims, 10 Drawing Sheets

(51) Int. Cl.
*B21D 5/12* (2006.01)
*B21B 31/08* (2006.01)
*B21C 37/08* (2006.01)

(58) Field of Classification Search
USPC ..... 72/238, 239
See application file for complete search history.

(56) References Cited

FOREIGN PATENT DOCUMENTS

| | | | | | |
|---|---|---|---|---|---|
| JP | 53109851 | A | * | 9/1978 | ..... B21B 13/04 |
| JP | 57181703 | A | * | 11/1982 | ..... B21B 31/10 |
| JP | 58215207 | A | * | 12/1983 | ..... B21B 13/10 |
| JP | H02-092409 | A | | 4/1990 | |
| JP | 07275953 | A | * | 10/1995 | |
| JP | H07-275953 | A | | 10/1995 | |
| JP | 08103817 | A | * | 4/1996 | |
| JP | H08-103817 | A | | 4/1996 | |
| JP | 2812781 | B2 | | 10/1998 | |
| JP | 5631337 | B2 | | 11/2014 | |
| KR | 20150105807 | A | * | 9/2015 | |

* cited by examiner

ROLL FORMING MACHINE

TECHNICAL FIELD

The present invention relates to a roll forming machine used for manufacturing welded pipes, more specifically, to a roll forming machine allowing changing of a roll to be done easily and having excellent economic performance.

BACKGROUND ART

In a manufacturing line of manufacturing welded pipes such as electric resistance welded pipes, while a band-like metallic plate is passed inside a large number of roll forming machines arranged along a forming line, the metallic plate is formed into a pipe-like shape and butting edges are welded to form a welded pipe. In such a pipe manufacturing line, a forming roll assembled into a roll stand in a roll forming machine is changed in response to a pipe manufacturing size. Regarding changing of such a forming roll, the forming roll is required to be changed promptly. Patent literature 1 suggests one roll forming machine responsive to this requirement.

The roll forming machine suggested in patent literature 1 is configured in such a manner that a horizontal roll stand with a pair of upper and lower horizontal rolls used for forming in a direction of a forming line is ejected toward one side of the forming line together with a screw down device for applying a pressing force to the horizontal rolls, thereby separating the horizontal roll stand from a driving mechanism arranged on the opposite side to be replaced with a different stand entirely. Generally, the one side of the forming line, namely, a side of ejecting the horizontal roll stand is called an operation side, and the opposite side is called a driving side.

In this roll forming machine, as the stand is replaced entirely during roll changing, the roll changing itself can be done promptly. When the roll stand is disassembled and the forming roll is recombined outside the forming line, namely, in what is called an off-line place, however, it takes time for removing the screw down device.

There is also a different roll forming machine suggested in patent literature 2. This roll forming machine is configured in such a manner that upper and lower horizontal rolls in a horizontal roll stand are coupled into a unit, and the resultant horizontal roll unit is ejected by a carriage from the interior of a stand frame of the horizontal roll stand toward an operation side and changed to a different horizontal roll unit. However, forming the horizontal rolls in the horizontal roll stand as a unit complicates the configuration of the entire stand to increase cost of manufacturing the stand. Additionally, this inevitably causes scale increase of the stand. Hence, in trying to locate a plurality of stands, a constraint of failing to reduce a pitch between the stands is caused.

Separately from the foregoing roll forming machines, patent literature 3 suggests a roll forming machine in which a stand frame is dividable into a driving side and an operation side, a driving-side part of the stand frame is left in a forming line, and an operation-side part of the stand frame is separated toward the operation side together with upper and lower horizontal rolls. During division of the stand frame, however, the upper and lower horizontal rolls are supported in a cantilever style by the operation-side part of the stand frame. This requires the stand frame to have higher rigidity to inevitably result in size increase and cost increase, causing a constraint in that a roll to be used is limited to a roll of a relatively small diameter. Additionally, the complication of the stand configuration resulting from the division of the stand frame is also inevitable.

PRIOR ART LITERATURES

Patent Literatures

Patent Literature 1: Japanese Patent Application Publication No. Hei 2-092409

Patent Literature 2: Japanese Patent Application Publication No. Hei 8-103817

Patent Literature 3: Japanese Patent Application Publication No. Hei 7-275953

SUMMARY OF INVENTION

Problem to be Solved by Invention

The present invention is intended to provide a roll forming machine allowing changing of a horizontal roll in a horizontal roll stand involving readjustment of an amount of pressing to be done readily and promptly, achieving size reduction and weight reduction easily, and having excellent economic performance.

Means of Solving Problem

A roll forming machine according to the present invention comprises:

a movable horizontal roll stand including one or a plurality of horizontal roll housings in which a pair of upper and lower horizontal rolls is housed, the horizontal roll housing including a pair of roll chock receivers with tops opened for removing the horizontal rolls upward, the horizontal roll housing being configured to retreat from the interior of a forming line to one side perpendicular to the forming line while being mounted on a carriage; and a fixed stand with an overhang part jutting out from a main frame standing upright on a counter-retreating side of the forming line and being supported in a cantilever style by the main frame.

After the horizontal roll stand returns to the interior of the forming line, the horizontal roll stand is housed directly below the overhang part of the fixed stand.

The overhang part is provided with:

a screw down device that applies a pressing force to the horizontal rolls in the horizontal roll housing in the forming line via the opened tops; and housing supports engaged with the opened tops of the horizontal roll housing in the forming line to support the horizontal roll housing.

In the roll forming machine according to the present invention, with the horizontal roll stand ejected from the interior of the forming line to a retreating side, the horizontal rolls in the horizontal roll housing are changed. During this changing, as the horizontal roll housing is opened at the top, the horizontal rolls are readily ejected upward and set in the horizontal roll housing from above readily through the opened top. Namely, the horizontal rolls are changed readily outside the forming line.

When a horizontal roll stand with a different type of horizontal rolls is moved into the forming line and a pressing force is applied from the screw down device provided to the overhang part of the fixed stand to a roll chock functioning as a roll journal box of the horizontal rolls in the horizontal roll housing, the horizontal roll housing is opened at the top and the pressing force is applied via this opened top. In this way, a mechanism of applying the pressing force is simplified.

When the screw down device provided to the overhang part of the fixed stand applies the pressing force to the roll chock of the horizontal rolls in the horizontal housing, resultant reaction force (upward reaction force) is applied to the overhang part. In this regard, as the overhang part supports the horizontal roll housing at the housing supports, this upward reaction force is applied as pulling force to the horizontal roll housing to reduce the upward reaction force applied to the overhang part. As a result, the configuration of the fixed stand is also simplified.

The screw down device is provided to the overhang part of the fixed stand and each horizontal roll stand becomes free from the screw down device. This further encourages simplification of the configuration of the horizontal roll housing. During retreating of the horizontal roll stand, the screw down device remains in the forming line together with the fixed stand. Thus, operating data about an amount of pressing is retained to eliminate a need for complicated readjustment.

In this way, the roll forming machine according to the present invention allows changing of the horizontal rolls in the horizontal roll stand involving readjustment of an amount of pressing to be done readily and promptly. The horizontal roll stand is given the simplified configuration and is reduced in size and weight easily. Thus, in trying to locate a plurality of stands, it becomes possible to reduce a pitch between the stands. Together with the configuration of the horizontal roll stand, the configuration of the fixed stand is simplified to allow cost reduction of the entire roll forming machine.

In the roll forming machine according to the present invention, the overhang part of the fixed stand, namely, the overhang part with the screw down device and the housing supports is preferably a movable part supported to be movable in an up-down direction relative to the fixed stand. With the overhang part as a movable part, when the screw down device presses the horizontal rolls in the horizontal roll housing, resultant reaction force moves up the overhang part to lock the horizontal roll housing with the housing supports. This achieves loose engagement during attachment and detachment between the housing supports and the horizontal roll housing to facilitate the engagement therebetween.

The housing supports may be engaged with the horizontal roll stand from both the front and rear sides corresponding to the upstream and downstream sides of the forming line, or from both the right and left sides across the forming line. In such cases, however, a key system such as a rotary system is required for the housing supports. By contrast, if the housing supports are to be engaged with a forming line upstream portion and a forming line downstream portion of the horizontal roll housing, the housing supports can be configured as slidable supports to be engaged sideway with the forming line upstream portion and the forming line downstream portion of the horizontal roll housing in response to motion of the horizontal roll stand of returning from the retreating side of the forming line into the forming line. This reduces movable parts to simplify the configuration to a greater degree.

If the housing supports are slidable supports, configuring the overhang part of the fixed stand to be movable in the up-down direction allows loose engagement of the housing supports with the horizontal roll housing. Thus, the sliding motion of the housing supports particularly facilitates the engagement therebetween.

The horizontal rolls in the horizontal roll stand are not limited to driven rolls but may be non-driven rolls. However, these rolls are generally driven rolls. In this case, the counter-retreating side of the forming line is a driving side on which a driving machine for driving the horizontal rolls in the horizontal roll stand is installed, and the retreating side is an operation side for changing of the horizontal rolls in the horizontal roll stand, etc.

At the horizontal roll stand, a vertical roll stand with a pair of right and left side rolls can be mounted on the carriage on which one or a plurality of horizontal roll housings is mounted to be adjacent to the horizontal roll stand from upstream and/or downstream of the forming line. This causes a plurality of roll stands once to be ejected to the outside of the forming line to allow prompt roll changing. Even with this configuration, the size increase of the forming machine is still avoided.

Regarding the arrangement of the horizontal roll stand and the vertical roll stand on the carriage, the following specific seven arrangements can be adopted as viewed from an upstream side toward a downstream side of the forming line, for example:

1) Vertical roll stand (vertical RS), horizontal roll stand (horizontal RS);

2) Horizontal RS, vertical RS, horizontal RS;

3) Vertical RS, horizontal RS, vertical RS, horizontal RS;

4) Horizontal RS, vertical RS, horizontal RS, vertical RS, horizontal RS;

5) Vertical RS, horizontal RS, vertical RS, horizontal RS, vertical RS, horizontal RS;

6) Horizontal RS, horizontal RS, vertical RS, horizontal RS; and

7) Vertical RS, horizontal RS, horizontal RS, horizontal RS.

Advantageous Effects of Invention

In the roll forming machine according to the present invention, the horizontal roll stand is a movable stand to retreat sideway from the interior of the forming line, and the horizontal roll housing in the horizontal roll stand is an open-top housing with an opened top. Further, the overhang part of the fixed stand is provided with the screw down device and the housing supports. As a result, changing of the horizontal rolls in the horizontal roll stand involving readjustment of an amount of pressing can be done readily and promptly. Additionally, the roll forming machine is given a simplified configuration, reduced in size and weight easily, and has excellent economic performance.

EMBODIMENTS FOR CARRYING OUT INVENTION

An embodiment of the present invention will be described below. A roll forming machine according to the embodiment is a forming roll stand array arranged in a manufacturing line of manufacturing electric resistance welded pipes, more specifically, a fin-pass (hereinafter called FP) roll stand array arranged upstream of a squeeze (hereinafter called SQ) roll stand.

In the following description, a direction of a forming line is expressed as an x direction, a horizontal direction at a right angle to the x direction is expressed as a y direction, and a vertical direction at a right angle to the x direction is expressed as a z direction. Further, the x direction corresponding to the forming line, the y direction, and the z direction are called a front-rear direction, a right-left direction or sideway, and an up-down direction respectively. A horizontal roll in an FP roll stand unit is a driven roll and driven to rotate by a roll driving mechanism arranged on one side of the forming line. For this reason, a side on which the roll driving mechanism is arranged is called a "driving side" of the forming line, and its opposite side is called an "operation side" of the forming line.

A front side of the forming line means an upstream side of the forming line, and a front part of the forming line means an upstream part of the forming line. Likewise, a rear side of the forming line means a downstream side of the forming line, and a rear part of the forming line means a downstream part of the forming line.

Figure 1:
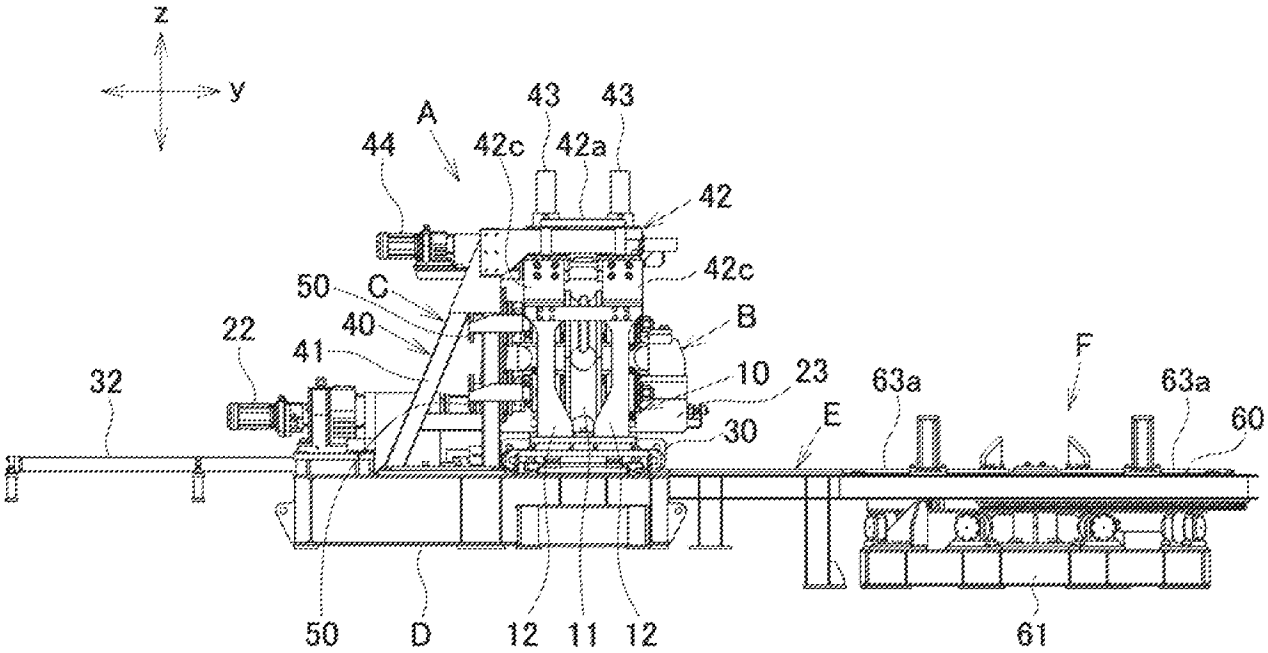
FIG. 1 is a front view of a roll forming machine showing an embodiment of the present invention and showing a state in which a movable stand array is combined.
Figure 2:
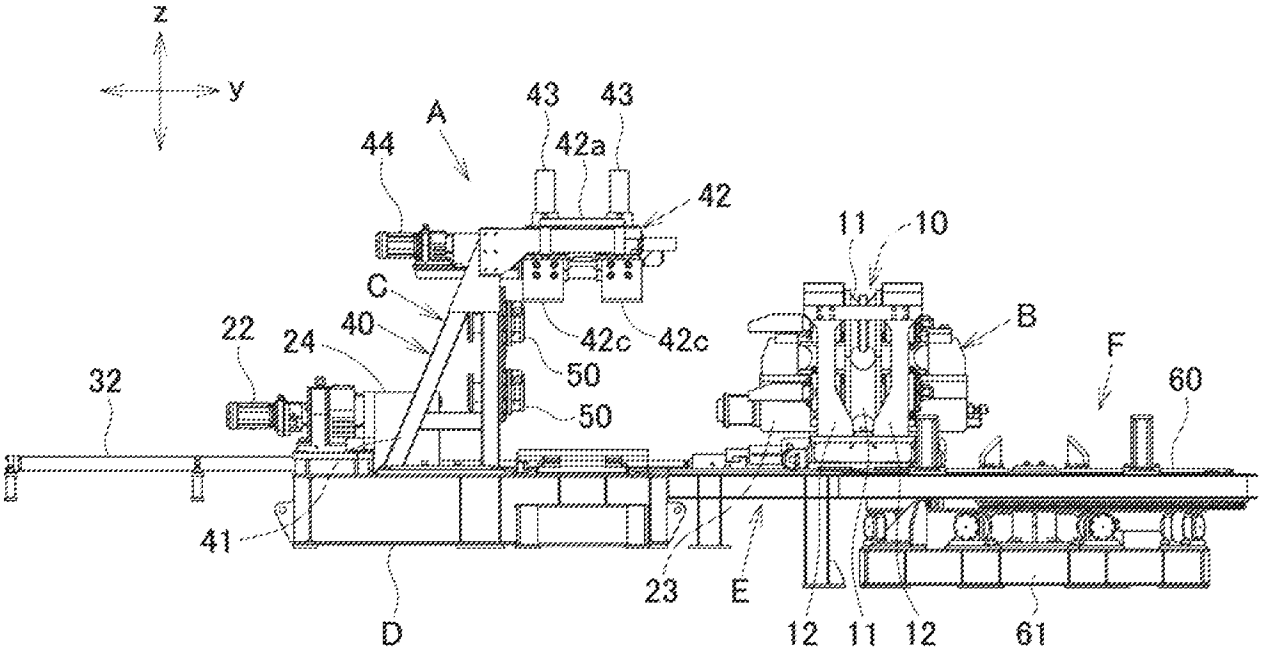
FIG. 2 is a front view of the roll forming machine according to the embodiment showing a state in which the movable stand array is separated.

As shown in FIGS. 1 and 2, a roll forming machine A is composed of a movable stand array B to move back and forth between the interior of the forming line and the operation side of the forming line, and a fixed unit C installed on the forming line and extending toward the driving side of the forming line. The roll forming machine A includes a main base D arranged directly below the forming line and extending toward the driving side of the forming line. The main base D is combined with an intermediate stage E arranged closer to the operation side than the main base D across the forming line and a standby stage F arranged still closer to the operation side than the intermediate stage E, thereby forming a stand array changing system.

Figure 3:
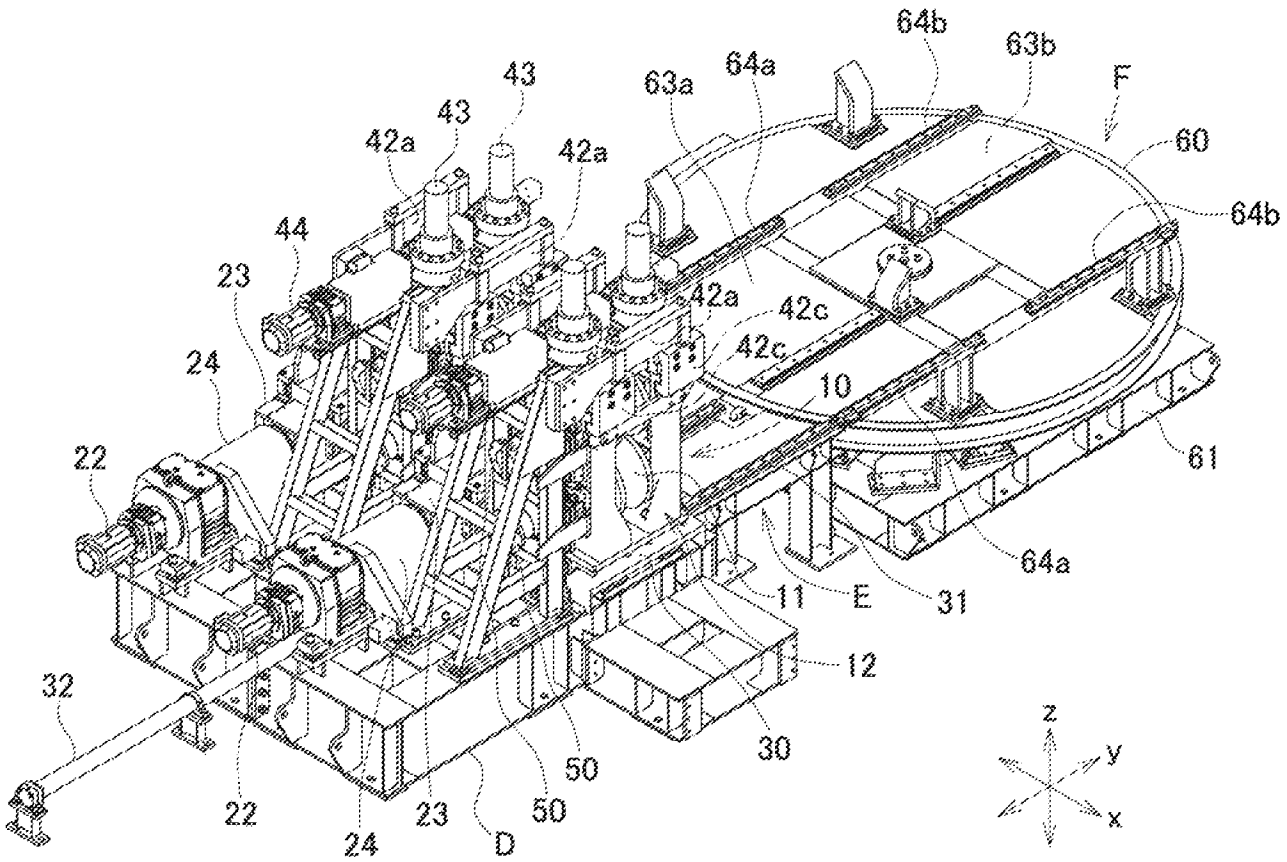
FIG. 3 is a perspective view of the roll forming machine according to the embodiment showing a state in which the movable stand array is combined.
Figure 4:
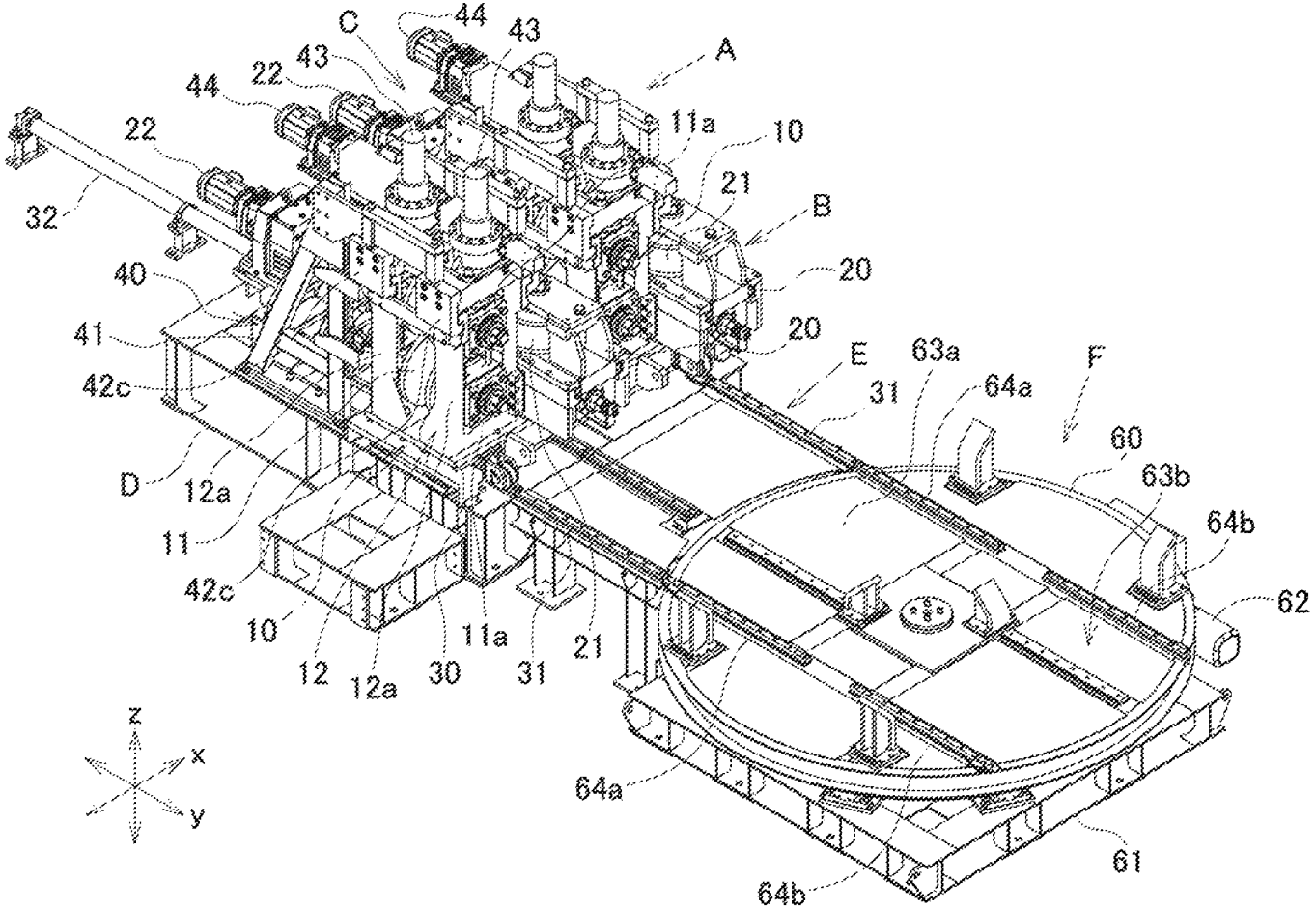
FIG. 4 is a perspective view of the roll forming machine according to the embodiment from a different angle showing a state in which the movable stand array is combined.
Figure 5:
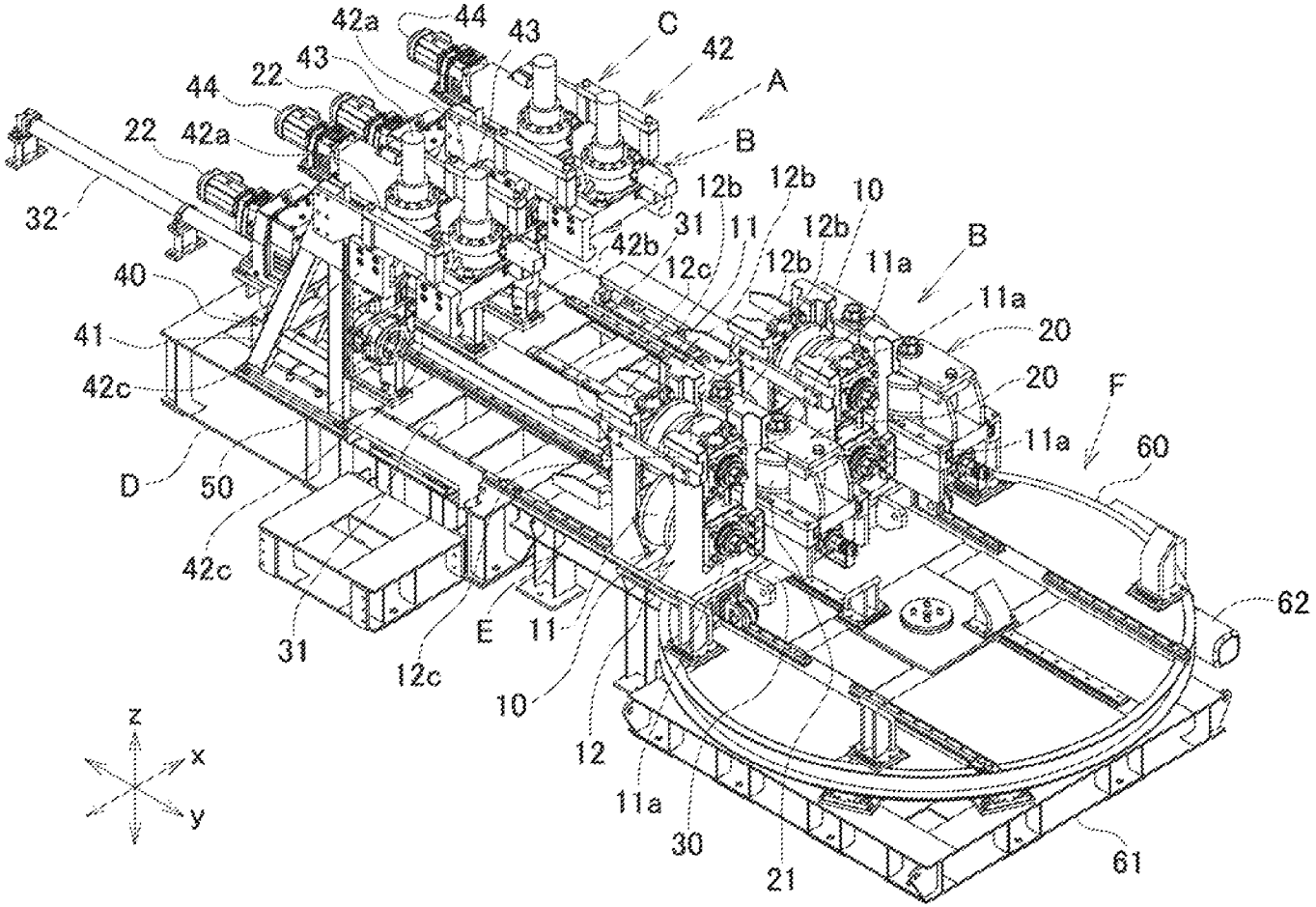
FIG. 5 is a perspective view of the roll forming machine according to the embodiment from a different angle showing a state in which the movable stand array is separated.

As shown in FIGS. 3 to 5, the movable stand array B in the roll forming machine A includes two horizontal roll stands 10 arranged in vertical rows in the direction of the forming line, and two vertical roll stands 20 also arranged in vertical rows in the direction of the forming line. The two horizontal roll stands 10 and the two vertical roll stands 20 are mounted alternately along the forming line on a common carriage 30.

The carriage 30 is located on rails 31 placed on the main base D in the roll forming machine A, particularly from a position directly below the forming line to extend over the intermediate stage D on the operation side. The carriage 30 is driven by a cylinder 32 installed as a carriage driving mechanism on the driving side of the forming line to move for retreat from a position on the forming line toward the operation side, and to move for return from the retreating position into the forming line. This further moves the movable stand array B between the interior of the forming line and a retreating side of the forming line, more specifically, between the interior of the fixed unit C of the roll forming machine A and a position on the standby stage F.

The horizontal roll stand 10 includes a pair of upper and lower horizontal rolls 11, 11. The horizontal rolls 11, 11 are driven rolls. With the horizontal roll stand 10 in a retreating state in the forming line, the horizontal rolls 11, 11 are coupled to the roll driving mechanism (not shown) via a pair of upper and lower intermediate joints 50, 50 installed on the driving side of the forming line, thereby driving the horizontal rolls 11, 11 to rotate.

Figure 6:
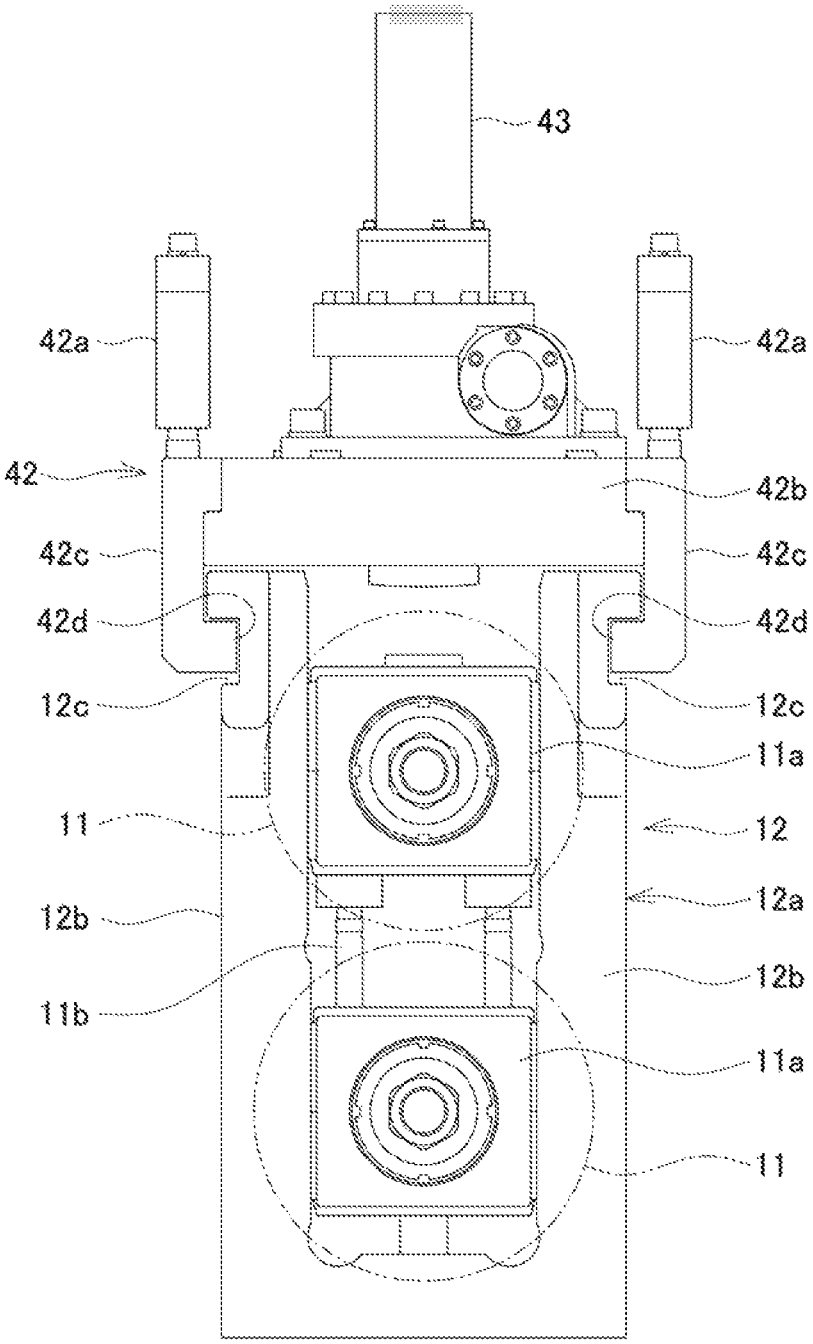
FIG. 6 is a side view of a principal part of the roll forming machine according to the embodiment in a non-pressed state.
Figure 7:
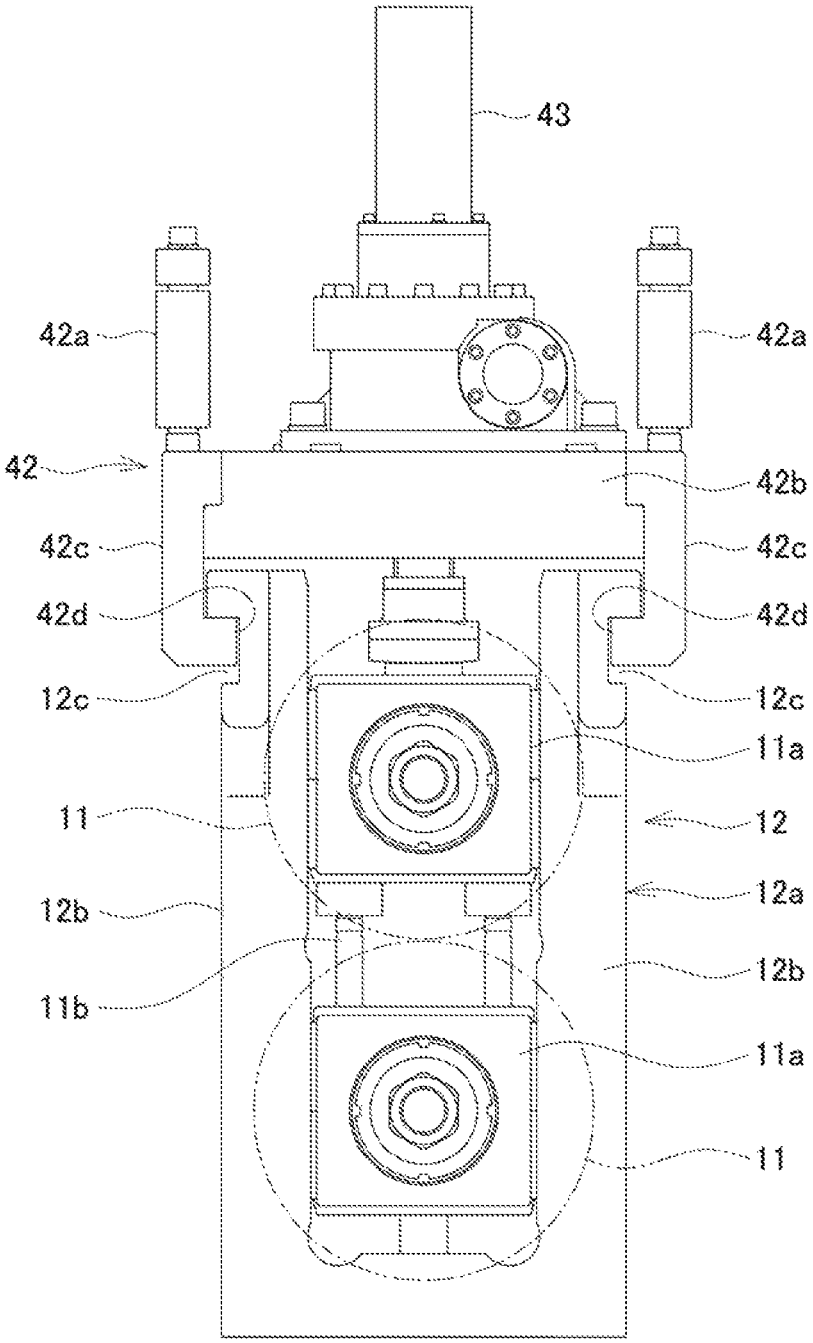
FIG. 7 is a side view of the principal part of the roll forming machine according to the embodiment in a pressed state.

The horizontal rolls 11, 11 are housed in a horizontal roll housing 12 with an opened top. In this state, the horizontal rolls 11, 11 are mounted on the carriage 30. The horizontal roll housing 12 includes a pair of right and left U-shaped members 12*a*, 12*a* fixed on the carriage 30. As shown in FIGS. 6 and 7, the right and left U-shaped members 12*a*, 12*a* are each formed into a U shape with an opened top as viewed from a side surface. The U-shaped members 12*a*, 12*a* support the upper and lower horizontal rolls 11, 11 by housing roll chocks 11*a*, 11*a* of the upper and lower horizontal rolls 11, 11 between front and rear vertical parts 12*b*, 12*b*.

To avoid contact of the upper horizontal roll 11 with the lower horizontal roll 11, the upper horizontal roll 11 is supported elastically at a predetermined height separated from the lower horizontal roll 11. For this support, an elastic mechanism 11*b* such as a coil spring is interposed between the upper and lower roll chocks 11*a*, 11*a*. At each of the right and left U-shaped members 12*a*, 12*a*, recesses 12*c* for engagement of hook-shaped housing supports 42*c* are provided at an upper front surface of the front-side vertical part 12*b* and an upper rear surface of the rear-side vertical part 12*b*, as will be described in detail later.

Figure 8:
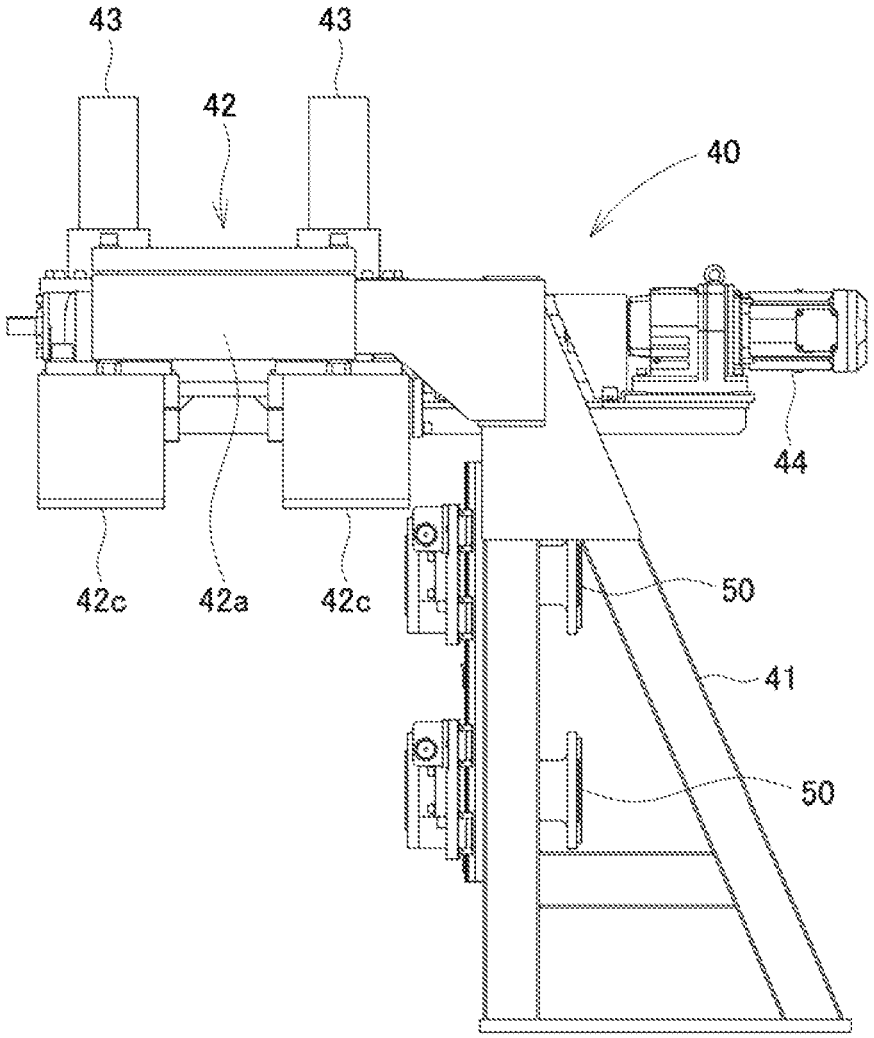
FIG. 8 is a back view of a fixed stand of the roll forming machine according to the embodiment.

The fixed unit C includes a pair of front and rear fixed stands 40, 40 installed on the main base D in corresponding relationships with the horizontal roll stands 10, 10. As shown in FIG. 8, each fixed stand 40 is composed of a main frame 41 standing upright on the driving side of the forming line, and an overhang part 42 jutting out from the head of the main frame 41 to extend over the forming line (namely, supported in a cantilever style by the main frame 41). After the horizontal roll stand 10 returns to the interior of the forming line, the horizontal roll stand 10 is housed directly below the overhang part 42. The pair of upper and lower intermediate joints 50, 50 is attached to the main frame 41.

The overhang part 42 includes a base plate 42*b* horizontally supported by a pair of front and rear horizontal beams 42*a*, 42*a*. The front and rear horizontal beams 42*a*, 42*a* are fixed parts coupled to the main frame 41. As shown in FIGS. 6 and 7, the base plate 42*b* is a movable plate supported to be movable in the up-down direction by the front and rear horizontal beams 42*a*, 42*a*. A pair of right and left screw down devices 43, 43 are attached in downward-pointed positions to the movable base plate 42*b*. The base plate 42*b* has a front edge to which a pair of front-side right and left housing supports 42*c*, 42*c* is attached, and a rear edge to which a pair of rear-side right and left housing supports 42*c*, 42*c* is also attached.

The front-side housing supports 42*c*, 42*c* each have a hook shape with a lower portion projecting rearward. With the horizontal roll stand 10 housed directly below the overhang part 42, projections 42*d*, 42*d* of the front-side housing supports 42*c*, 42*c* are engaged from the front side with front-side recesses 12*c*, 12*c* formed at the front surfaces of the front-side vertical parts 12*b*, 12*b* of the right and left U-shaped members 12*a*, 12*a*. The rear-side housing supports 42*c*, 42*c* each have a hook shape with a lower portion bent frontward. With the horizontal roll stand 10 housed directly below the overhang part 42, projections 42*d*, 42*d* of the rear-side housing supports 42*c*, 42*c* are engaged from the rear side with rear-side recesses 12*c*, 12*c* formed at the rear surfaces of the rear-side vertical parts 12*b*, 12*b* of the right and left U-shaped members 12*a*, 12*a*.

During return of the horizontal roll stand 10 from the operation side of the forming line into the forming line, the respective projections of the front-side hook-shaped housing supports 42*c*, 42*c* are fitted and engaged sideway in a sliding manner with the front-side recesses 12*c*, 12*c* as the forming line upstream portions of the horizontal roll housing 12, and the respective projections 42*d* of the rear-side hook-shaped housing supports 42*c*, 42*c* are fitted and engaged sideway in a sliding manner with the rear-side recesses 12*c*, 12*c* as the forming line downstream portions of the horizontal roll housing 12. To achieve these engagements easily and smoothly, the recesses 12*c*, 12*c* are placed at greater heights, especially than the respective projections 42*d* of the housing supports 42*c*, 42*c*.

With the horizontal roll stand 10 housed directly below the overhang part 42, the right and left screw down devices 43, 43 attached in downward-pointed positions to the base plate 42*b* are configured to apply pressing forces from above to the right and left U-shaped members 12*a*, 12*a*, particularly to the right and left roll chocks 11*a*, 11*a* of the upper horizontal roll 11. A motor 44, which is a driving mechanism common to the screw down devices 43, 43, is located closer to the driving side than the screw down devices 43, 43 and attached to the base plate 42*b* together with the screw down devices 43, 43.

The upper and lower intermediate joints 50, 50 are connected to the horizontal rolls 11, 11 in the horizontal roll stand 10 and attached to the main frame 41 of the fixed stand 40. The upper and lower horizontal rolls 11, 11 become connected to the upper and lower intermediate joints 50, 50 by inserting rectangular columnar slidable input shafts 11*c*, 11*c* (see FIG. 9) provided at an edge of the driving side into the upper and lower intermediate joints 50, 50 (see FIG. 8), thereby coupling the upper and lower horizontal rolls 11, 11 to the roll driving mechanism (not shown) provided still closer to the driving side than the intermediate joints 50, 50.

The vertical roll stand 20, which is mounted on the carriage 30 in an adjacent position to the horizontal roll stand 10, includes a pair of built-in right and left vertical rolls 21, 21. The dimension of a gap between the right and left vertical rolls 21, 21 is set by a roll position adjusting motor 22 installed on the driving side of the forming line. More specifically, a gap adjuster 23 provided in the vertical roll stand 20 is connectable to a coupling 24 connected to the gap adjusting motor 22. With the roll stand 20 in a returning state in the forming line, the gap adjuster 23 is connected to the motor 22 via the coupling 24. With the roll stand 20 in a retreating state outside the forming line, the gap adjuster 23 is disconnected from the coupling 24.

The standby stage F, which is arranged still closer to the operation side than the intermediate stage E, includes a horizontal turntable 60. The turntable 60 is rotatably supported on a base 61 and driven to rotate by a motor-powered rotation driving mechanism 62 attached to a side surface of the base 61. A first standby stage 63*a* is defined on one of sides across a center of rotation on the turntable 60, and a second standby stage 63*b* is defined on the other side. The turntable 60 is driven to rotate by the rotation driving mechanism 62 for selectively making the first standby stage 63*a* or the second standby stage 63*b* face the roll forming machine A in the forming line.

First rails 64*a* are placed on the first standby stage 63*a*. The first rails 64*a* are to be connected to the rails 31 on the intermediate stage E extending from the main base C when the first standby stage 63*a* faces the roll forming machine A. Likewise, second rails 64*b* are placed on the second standby stage 63*b*. The second rails 64*b* are to be connected to the rails 31 on the intermediate stage E extending from the main base C when the second standby stage 63*b* faces the roll forming machine A.

The configuration of the roll forming machine A according to the embodiment and that of the stand array changing system using the roll forming machine A have been described above. In the following, the characteristics of the roll forming machine A in terms of its operation and effect will be shown clearly by describing the motion of the stand array changing system by referring to FIG. 9.

Figure 9:
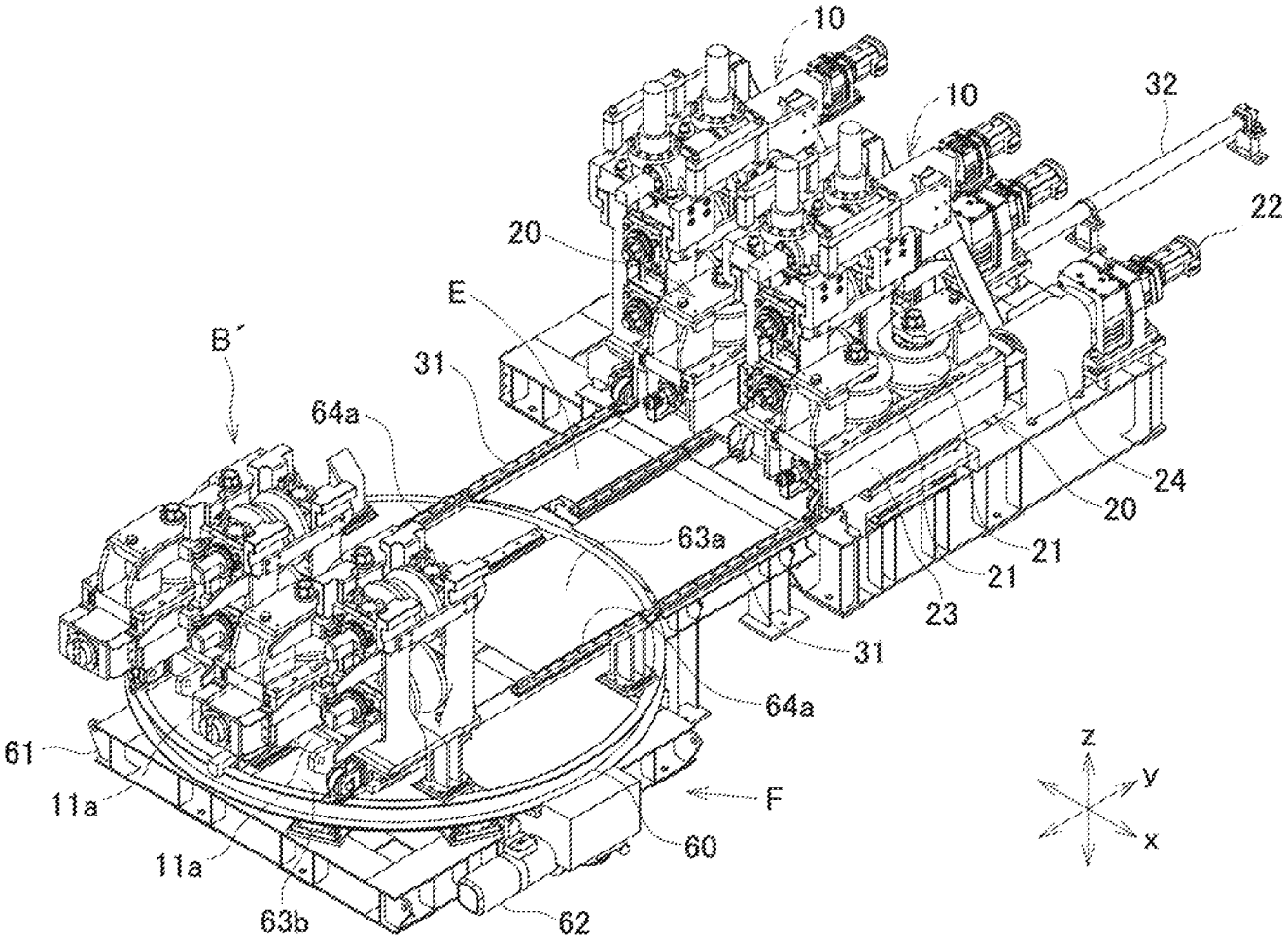
FIG. 9 is a perspective view showing how the roll forming machine according to the embodiment is used.

In a state shown in FIG. 9, the first standby stage 63*a* of the standby stage F is empty in the absence of a movable stand array. In the second stage 63*b*, a movable stand array B' of a different type from the movable stand array B in the roll forming machine A is placed.

The movable stand array B and the movable stand array B' differ from each other only in the dimensions of forming hole dies of the upper and lower horizontal rolls 11, 11 assembled in each of the two horizontal roll stands 10, 10 and the dimensions of forming hole dies of the right and left vertical rolls 21, 21 assembled in each of the two right and left vertical roll stands 20, 20, and are the same in the other configuration.

As shown in FIGS. 1, 3, 4, and 9, in a step of manufacturing an electric resistance welded pipe, the movable stand array B in the roll forming machine A, namely, the two horizontal roll stands 10 and the two vertical roll stands 20 aligned on the carriage 30 in the direction of the forming line, are present in the forming line. More specifically, the movable stand array B is combined with the fixed unit C and housed directly below the overhang part 42 of the fixed stand 40. In each horizontal roll stand 10, the upper and lower horizontal rolls 11, 11 are coupled via the intermediate joints 50, 50 arranged on the driving side of the forming line to the roll driving mechanism (not shown) still closer to the driving side, thereby driving the upper and lower horizontal rolls 11, 11 to rotate.

As shown in FIGS. 6 and 7, the right and left screw down devices 43, 43 provided to the overhang part 42 of the fixed stand 40 adjust the upper horizontal roll 11 in the horizontal roll stand 10, more specifically, adjust the right and left roll chocks 11*a*, 11*a* of the upper horizontal roll 11 to predetermined positions. At this time, as the right and left U-shaped members 12*a*, 12*a* of the horizontal roll housing 12 of the horizontal roll stand 10 are opened upward, the right and left roll chocks 11*a*, 11*a* are pressed directly via the opened tops of the right and left U-shaped members 12*a*, 12*a*.

As a result of this pressing, the elastic mechanism 11*b* interposed between the upper and lower roll chocks 11*a*, 11*a* contracts, and resultant reaction force (upward reaction force) is applied to the base plate 42*b* of the overhang part 42 to lift the base plate 42*b*. By doing so, the front-side hook-shaped housing supports 42*c*, 42*c* and the rear-side hook-shaped housing supports 42*c*, 42*c* attached to the base plate 42*b* are lifted to lock the horizontal roll housing 12.

Here, the base plate 42*b* is lifted for locking the horizontal roll housing 12 only by applying pressure using the right and left screw down devices 43, 43. As an alternative to this or in addition to this, the base plate 42*b* can be lifted for locking the horizontal roll housing 12 using a clamp cylinder attached to the base plate 42*b* side or to the horizontal roll housing 12 side.

During forming, large upward reaction force for the forming is applied to the upper horizontal roll 11 and transmitted to the overhang part 42. In this regard, as the overhang part 42 is coupled to the horizontal roll housing 12 using the front and rear housing supports 42*c*, 42*c*, the reaction force for the forming applied to the overhang part 42 is reduced significantly. As a result, the configuration of the fixed stand 40 including the overhang part 42 is simplified while high rigidity is ensured.

At the vertical roll stand 20, the gap adjuster 23 is connected to the coupling 24 arranged on the driving side of the forming line to be coupled to the roll position adjusting motor 22. As a result, the dimension of the gap is set at a predetermined value.

If roll changing is necessitated by the change in size of an electric resistance welded pipe to be manufactured, to stop pressing using the screw down devices 43, 43, the motor 44 mounted on the overhang part 42 is actuated at the horizontal roll stand 10. In response to this, the horizontal roll stand 10 is released from the locking using the overhang part 42, namely, the locking using the front-side hook-shaped stand supports 42*c*, 42*c* and further using the rear-side hook-shaped stand supports 42*c*, 42*c*.

In this state, the cylinder 32 installed on the driving side of the forming line is actuated to move the carriage 30 for retreat toward the operation side of the forming line. More specifically, the carriage 30 is pushed onto the first standby stage 63*a* of the turntable 60 at the standby stage F. By doing so, the movable stand array B in the roll forming machine A is moved for retreat onto the first stage 63*a* of the turntable 60.

At this time, while the right and left screw down devices 43, 43 are left at the overhang part 42 of the fixed stand 40, the horizontal roll stand 10 moves for retreat onto the first standby stage 63*a* of the turntable 60. The front-side hook-shaped stand supports 42*c*, 42*c* are slidable supports to be engaged from the front side with the front-side vertical members 12*b*, 12*b* of the right and left U-shaped members 12*a*, 12*a* as the forming line upstream portions of the horizontal roll housing 12, and the rear-side hook-shaped stand supports 42*c*, 42*c* are slidable supports to be engaged from the rear side with the rear-side vertical parts 12*b*, 12*b* of the right and left U-shaped members 12*a*, 12*a* as the forming line downstream portions of the horizontal roll housing 12. Thus, these supports 42*c* do not hinder the motion of the horizontal roll stand 10 of retreating to the outside of the forming line.

In response to the retreating motion of the horizontal roll stand 10, the respective input shafts 11*c*, 11*c* of the upper and lower horizontal rolls 11, 11 of this horizontal roll stand 10 are pulled out of the upper and lower intermediate joints 50, 50 arranged on the driving side of the forming line to separate these horizontal rolls 11, 11 from the roll driving mechanism (not shown).

At the vertical roll stand 20, this vertical roll stand 20 retreats toward the operation side of the forming line together with the horizontal roll stand 10. As a result, the gap adjuster 23 is separated from the coupling 24 and then separated from the roll position adjusting motor 22.

When the movable stand array B in the roll forming machine A moves for retreat onto the first retreat stage 63*a* of the turntable 60, the turntable 60 makes a half turn to make the second retreat stage 63*b* face the roll forming machine A. Then, the cylinder 32 is actuated in the opposite direction to pull the movable stand array B' placed on the second standby stage 63*b* of the turntable 60 into the fixed unit C of the roll forming machine A.

At this time, at the horizontal roll stand 10, the front-side hook-shaped stand supports 42*c*, 42*c* attached to the overhang part 42 of the fixed stand 40 are engaged sideway in a sliding manner with the front-side recesses 12*c*, 12*c* of the right and left U-shaped members 12*a*, 12*a*, and the rear-side hook-shaped stand supports 42*c*, 42*c* are also engaged sideway in a sliding manner with the rear-side recesses 12*c*, 12*c* of the right and left U-shaped members 12*a*, 12*a*.

At the same time, the input shafts 11*c*, 11*c* of the upper and lower horizontal rolls 11, 11 are inserted into the upper and lower intermediate joints 50, 50 arranged on the driving side of the forming line to be coupled to the roll driving mechanism.

At the vertical roll stand 20, the gap adjuster 23 is connected to the coupling 24 to be coupled to the roll position adjusting motor 22.

As a result, the movable stand array B in the roll forming machine A is replaced with the different movable stand array B', thereby changing the horizontal rolls 11, 11 of the horizontal roll stand 10 and the vertical rolls 21, 21 of the vertical roll stand 20 simultaneously. Changing of the horizontal rolls 11, 11 does not require removal of the screw down device 43 from the horizontal roll stand 10, so that the horizontal rolls 11, 11 are changed easily.

For restarting manufacture of electric resistance welded pipes, pressing forces are applied from the right and left screw down devices 43, 43 to the upper horizontal roll 11 at the horizontal roll stand 10. While the horizontal roll stand 10 is retreating on the operation side of the forming line, the right and left screw down devices 43, 43 still remain in the forming line and retain operating data about an amount of pressing. Thus, pressing forces are not required to be adjusted again for application of the pressing forces to the changed horizontal roll 11. This allows roll changing to be done promptly and efficiently.

At the movable stand arrays B and B', the upper and lower horizontal rolls 11, 11 of the horizontal roll stand 10 are changed outside the forming line, if necessary. The horizontal roll housing 12 of the horizontal roll stand 10 is opened upward, so that the horizontal rolls 11, 11 are changed readily through this opened top by crane lifting, for example.

In this way, in the roll forming machine A, changing of the horizontal rolls 11, 11 in the horizontal roll stand 10 involving readjustment of an amount of pressing is done readily and promptly. Further, the horizontal roll stand 10 has a simplified configuration and is reduced in size and weight easily. Thus, in trying to locate a plurality of stands, it becomes possible to reduce a pitch between the stands to shorten a line length. Together with the configuration of the horizontal roll stand 10, the configuration of the fixed stand 40 is simplified to allow significant reduction in total cost.

Figure 10:
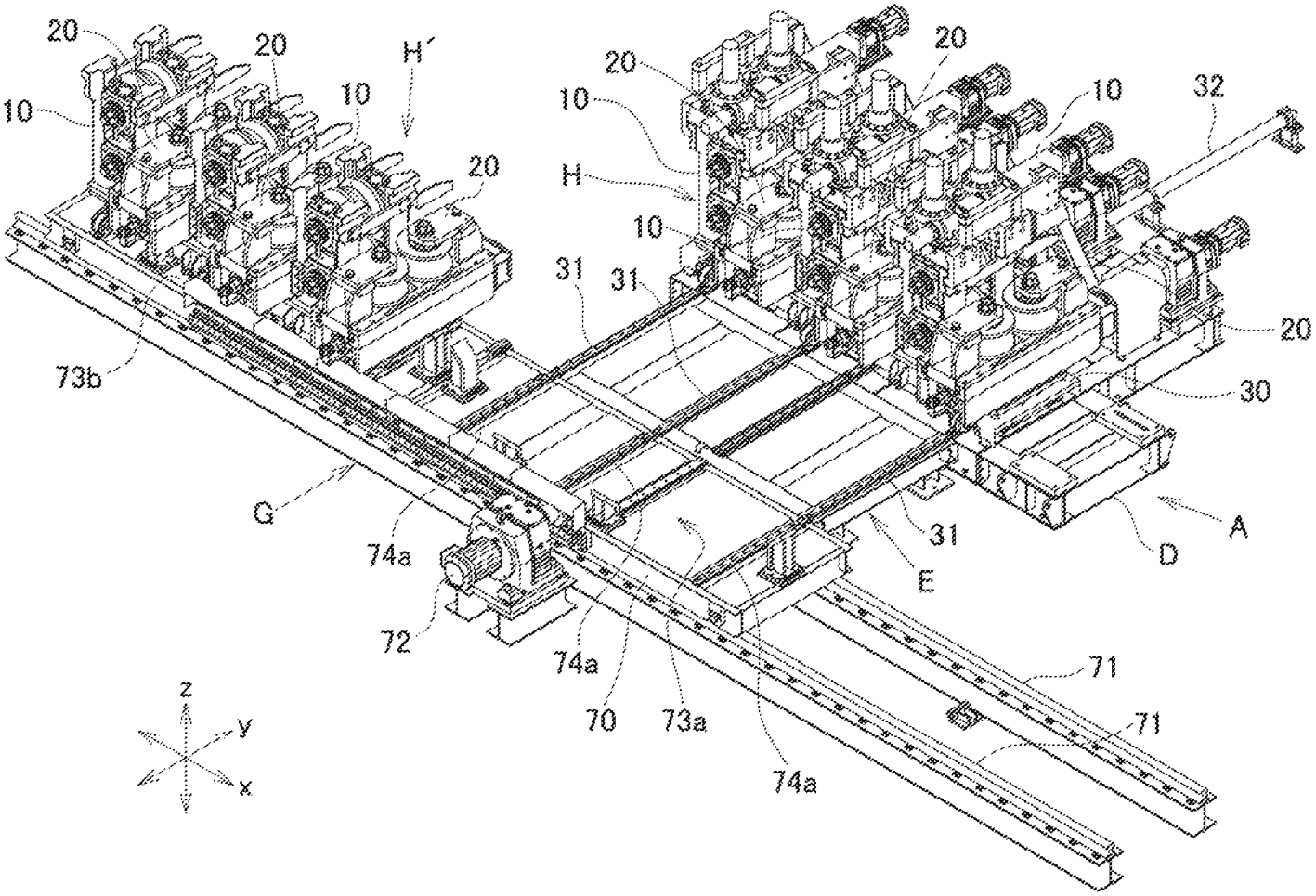
FIG. 10 is a perspective view showing how a different roll forming machine is used.

FIG. 10 shows a different stand array changing system. This stand array changing system is a linearly movable system and includes a standby stage G arranged parallel to the operation side of the forming line. The standby stage G is a linearly movable carriage 70 located on rails 71 parallel to the forming line and is driven by a motor-powered linear driving mechanism 72 installed outside the rails 71 to move back and forth along the forming line.

In a traveling direction of the standby stage G, the standby stage G has a first half functioning as a first standby stage 73*a* and a rear half functioning as a second standby stage 73*b*. The linearly movable carriage 70 in the movable stage 70 is linearly driven by the linear driving mechanism 72 for selectively making the first standby stage 73*a* or the second standby stage 73*b* adjoin the roll forming machine A in the forming line.

First rails 74*a* are placed on the first standby stage 73*a*. The first rails 74*a* are to be connected to the rails 31 in the roll forming machine A when the first standby stage 73*a* adjoins the roll forming machine A in the forming line. Likewise, second rails 74*b* are placed on the second standby stage 63*b*. The second rails 74*b* are to be connected to the rails 31 in the roll forming machine A when the second standby stage 63*b* adjoins the roll forming machine A in the forming line.

In a state shown in FIG. 10, the first standby stage 73*a* is empty in the absence of a movable stand array. A movable stand array H' of a different type from a movable stand array H in the roll forming machine A is placed on the second standby stage 73*b*.

Each of the movable stand arrays H and H' is a sizing (SZ) roll stand array arranged downstream of an SQ roll stand, and includes three horizontal roll stands 10 and three vertical roll stands 20 arranged alternately on the carriage 30 along the forming line. The movable stand array H and the movable roll stand array H' differ from each other only in the dimensions of forming hole dies of the upper and lower horizontal rolls 11, 11 assembled in each of the three horizontal roll stands 10 and the dimensions of forming hole dies of the right and left vertical rolls 21, 21 assembled in each of the three vertical roll stands 20, and are the same in the other configuration.

For roll changing, with the first standby stage 73*a* on the carriage 70 adjoining the roll forming machine A in the forming line, particularly adjoining the movable stand array H in the roll forming machine A, the cylinder 32 in the roll forming machine A is actuated to push the carriage 30 in the roll forming machine A onto the first standby stage 73*a* of the carriage 70. This moves the movable stand array H in the roll forming machine A for retreat onto the first standby stage 73*a*. When the movement for retreat is finished, the carriage 70 moves frontward to make the second standby stage 73*b* adjoin the roll forming machine A. Next, the cylinder 32 is actuated in the opposite direction to pull the movable stand array H' on the second standby stage 73*b* into the fixed unit C of the roll forming machine A.

As a result, the movable stand array H is replaced with the movable stand array H' in the roll forming machine A. In this way, the roll changing is finished. On the linearly movable carriage 70 of the standby stage G, rolls are changed in the movable stand array H on the first standby stage 73*a* or the movable stand array H' on the second standby stage 73*b*, if necessary. These rolls are to be changed readily for the reason given above.

REFERENCE SIGNS LIST

A Roll forming machine
B, B', H, H' Movable stand array
C Fixed unit
D Main base
E Intermediate stage
F, G Standby stage
10 Horizontal roll stand
11 Horizontal roll
11*a* Roll chock
11*b* Elastic mechanism
11*c* Input shaft
12 Horizontal roll housing
12*a* U-shaped member
12*b* Vertical part
12*c* Recess
20 Vertical roll stand
21 Vertical roll
22 Roll position adjusting motor
23 Gap adjuster
24 Coupling
30 Carriage
31 Rail
40 Fixed stand
41 Main frame
42 Overhang part
42*a* Horizontal beam
42*b* Base plate
42*c* Housing support
42*d* Projection
43 Screw down device
50 Intermediate joint
60 Turntable
61 Base
62 Rotation driving mechanism
63*a* First standby stage
63*b* Second standby stage
64*a* First rail
64*b* Second rail
70 Linearly movable carriage
71 Rail
72 Linear driving mechanism
73*a* First standby stage
73*b* Second standby stage
74*a* First rail
74*b* Second rail

The invention claimed is:

1. A roll forming machine comprising:

a movable horizontal roll stand including one or a plurality of horizontal roll housings in each of which a pair of upper and lower horizontal rolls is housed, the horizontal roll housing including a pair of roll chock receivers with a top opened for removing the horizontal rolls upward through the opened top of the horizontal roll housing, the horizontal roll housing being configured to retreat from a position on a forming line to a position outside of the forming line on a retreating side that is one side of the forming line perpendicular to the forming line while being mounted on a carriage;

a fixed stand with an overhang part jutting out from a main frame standing upright outside of the forming line on a counter-retreating side that is an opposite side of the forming line from the retreating side to extend over the forming line and being supported in a cantilever style by the main frame; and first and second roll chocks configured to respectively support opposite ends of the upper horizontal roll, wherein the horizontal roll housing which is returned to the position on the forming line is housed directly below the overhang part of the fixed stand, and the overhang part is provided with:

first and second screw down devices for applying pressing forces respectively to the first and second roll chocks of the upper horizontal roll in the horizontal roll housing which is at the position on the forming line via the opened top, the first and second screw down devices being left at the overhang part when the horizontal roll housing is retreated to the position outside of the forming line; and housing supports engaged with the opened top of the horizontal roll housing in the forming line to support and lock the horizontal roll housing, wherein the overhang part of the fixed stand is supported in such a manner as to be movable together with the first and second screw down devices and the housing supports in an up-down direction relative to the fixed stand.

2. The roll forming machine according to claim 1, wherein the retreating side is an operation side for changing of the horizontal rolls in the horizontal roll stand.

3. The roll forming machine according to claim 1, wherein the housing supports provided to the overhang part are slidable supports to be engaged sideway with a forming line upstream portion and a forming line downstream portion of the horizontal roll housing in response to motion of the horizontal roll housing of the horizontal roll stand of returning from the position outside of the forming line on the retreating side of the forming line into the forming line.

4. The roll forming machine according to claim 1, wherein the housing supports provided to the overhang part are slidable supports to be engaged sideway with a forming line upstream portion and a forming line downstream portion of the horizontal roll housing in response to motion of the horizontal roll stand of returning from the retreating side of the forming line into the forming line.

5. The roll forming machine according to claim 1, wherein a vertical roll stand with a pair of right and left side rolls is mounted on the carriage of the horizontal roll stand to be adjacent to the horizontal roll housing from upstream and/or downstream of the forming line.

6. The roll forming machine according to claim 4, wherein the retreating side is an operation side for changing of the horizontal rolls in the horizontal roll stand.

7. The roll forming machine according to claim 4, wherein a vertical roll stand with a pair of right and left side rolls is mounted on the carriage of the horizontal roll stand to be adjacent to the horizontal roll housing from upstream and/or downstream of the forming line.

* * * * *